US009765792B2

(12) United States Patent
Köppler

(10) Patent No.: US 9,765,792 B2
(45) Date of Patent: Sep. 19, 2017

(54) CENTRIFUGAL PUMP FOR DELIVERING LIQUIDS IN A MOTOR VEHICLE

(71) Applicant: CONTINENTAL AUTOMOTIVE GMBH, Hannover (DE)

(72) Inventor: Peter Köppler, Bad Vilbel (DE)

(73) Assignee: Continental Automotive GmbH, Hannover (DE)

( * ) Notice: Subject to any disclaimer, the term of this patent is extended or adjusted under 35 U.S.C. 154(b) by 621 days.

(21) Appl. No.: 14/357,148

(22) PCT Filed: Nov. 9, 2012

(86) PCT No.: PCT/EP2012/072209
§ 371 (c)(1),
(2) Date: May 8, 2014

(87) PCT Pub. No.: WO2013/068512
PCT Pub. Date: May 16, 2013

(65) Prior Publication Data

US 2015/0086342 A1 Mar. 26, 2015

(30) Foreign Application Priority Data

Nov. 10, 2011 (DE) ..... 10 2011 086 128

(51) Int. Cl.
*F04D 29/16* (2006.01)
*F04D 29/22* (2006.01)
*F04D 1/00* (2006.01)

(52) U.S. Cl.
CPC ..... *F04D 29/167* (2013.01); *F04D 1/00* (2013.01); *F04D 29/2266* (2013.01)

(58) Field of Classification Search
CPC . F04D 29/16; F04D 1/00; F04D 25/06; F03B 11/00
See application file for complete search history.

(56) References Cited

U.S. PATENT DOCUMENTS 2,704,232 A * 3/1955 Johnston ..... F04D 29/0462 29/898.055
2008/0260515 A1 10/2008 Anami et al.

FOREIGN PATENT DOCUMENTS

| | | |
|---|---|---|
| CN | 2311637 | 3/1999 |
| CN | 200999749 | 1/2008 |
| CN | 101187385 | 5/2008 |
| DE | 714290 | 11/1941 |
| FR | 386812 A | 6/1908 |

OTHER PUBLICATIONS

Title: "Centrifugal pumps"—Handbook for development, system planning and operation; Johann Friedrich Gülich; Springer Verlag; edition 1; chapter 3.6.2; Jan. 1999; pp. 73-78).

* cited by examiner

*Primary Examiner* — Mark Laurenzi
*Assistant Examiner* — Shafiq Mian
(74) *Attorney, Agent, or Firm* — Cozen O'Connor

(57) ABSTRACT

In a centrifugal pump for delivering liquids in a motor vehicle, annular webs project into a gap seal between a housing part and a cover disc of a rotor. The webs are arranged on both components of the housing part and of the cover disc and delimit chambers which accelerate, decelerate and divert a flow. In this way, the gap seal has a high throttling action.

8 Claims, 2 Drawing Sheets

CENTRIFUGAL PUMP FOR DELIVERING LIQUIDS IN A MOTOR VEHICLE

CROSS-REFERENCE TO RELATED APPLICATIONS

This is a U.S. national stage of application No. PCT/EP2012/072209, filed on 9 Nov. 2012, which claims priority to the German Application No. 10 2011 086 128.9, filed 10 Nov. 2011, the content of both incorporated herein by reference.

BACKGROUND OF THE INVENTION

1. Field of the Invention

The invention relates to a centrifugal pump for delivering liquids in a motor vehicle, having a housing, having an intake duct and an outlet duct in the housing, having a driven rotor, which can rotate in the housing, having rotor blades, which project from a supporting disk of the rotor, and having a cover disk, which connects free ends of rotor blades, and having a gap seal between the cover disc and a housing part of the housing, which housing part lies opposite the cover disk.

2. Related Art

Centrifugal pumps of this kind are often used in modern motor vehicles to deliver water and are known in practice. The intake duct of the known centrifugal pump is directed to the center of the rotor. The outlet duct adjoins the radially outer circumference of the rotor. Liquid in the center of the rotor reaches the rotor blades and is delivered radially outward to the outlet duct as the rotor rotates. A gap, which leads from the outlet duct to the intake duct and is sealed off by a gap seal, is thus formed between the side of the rotor having the cover disk and the housing part situated opposite the cover disk. In the simplest case, the gap seal is a particularly narrow gap, which restricts the flow from the radially outer side of the rotor, which is at a high pressure, to the radially inner side of the rotor, which is at a low pressure. The restriction has a decisive effect on the efficiency of the centrifugal pump. However, it is not possible to reduce the size of the gap arbitrarily because tolerances of the components must be prevented from leading to rubbing of the cover disk on the housing part.

BACKGROUND OF THE INVENTION

An object of the invention is to develop a centrifugal pump of the type stated at the outset in such a way that it has a particularly high efficiency and can be produced at a particularly favorable cost.

According to an aspect of the invention, this problem is solved by the fact that in each case at least one projecting annular web of the gap seal is arranged on the cover disk and on the housing part, and that the web of the housing part is offset relative to the web of the cover disk.

By virtue of this configuration, a flow leading from the intake duct to the outlet duct is guided along a particularly long path in the gap seal. Moreover, the flow undergoes a number of deflections as a result, leading to a particularly high restricting effect of the gap seal. By virtue of the high restricting effect of the gap seal, the centrifugal pump according to the invention has a particularly high efficiency. The webs are particularly simple to manufacture, and therefore the centrifugal pump according to the invention furthermore has particularly low manufacturing costs.

The webs could each be taken as far as the center of the gap seal, for example. However, according to another advantageous aspect of the invention, it helps to increase the number of deflections and increase the restricting effect of the gap seal if webs arranged opposite one another each project over half the height of the gap seal.

According to an advantageous aspect of the invention, the gap seal has a particularly high restricting effect if a plurality of chambers bounded by the webs in the gap seal has different cross sections. The different cross sections of the chambers in the gap seal lead to a number of changes in the velocity of the flow, leading to the restriction thereof.

According to another advantageous aspect of the invention, a particularly high restricting effect of the gap seal combined with particularly simple production can be achieved in a simple manner if the gap seal has respective annular ducts close to the intake duct and close to the outlet duct, the ducts being arranged perpendicularly to the plane of the supporting disk of the rotor, if the annular ducts are connected to one another by a transverse duct and if the webs project into the transverse duct. This configuration enables the components bounding the gap seal to be joined axially in a simple manner and manufactured at low cost, e.g. by injection molding. Moreover, this means that the gap seal is of stepped design, contributing to a particularly high restricting effect.

According to another advantageous aspect of the invention, the webs oppose the flow in the gap seal if the transverse duct connecting the annular ducts to one another slopes relative to the plane of the supporting disk of the rotor, and if the webs projecting into the transverse duct are arranged perpendicularly to the plane of the supporting disk of the rotor. The alignment of the webs relative to the transverse duct gives rise to high turbulence in the flow, ensuring that the gap seal has a particularly high restricting effect. Since the height of the rotor blades relative to the radially outer boundary of the rotor decreases in any case, this configuration furthermore leads to a particularly low consumption of materials and hence to particularly low manufacturing costs.

According to another advantageous aspect of the invention, a contribution to a further increase in the number of deflections of the flow and hence to the restricting effect in the gap seal is made if at least one of the annular ducts is connected to the intake duct or the outlet duct by a transverse duct. According to another advantageous development of the invention, the webs can be produced in a particularly simple manner during the manufacture of the components by injection molding if the webs taper toward the free end thereof. By virtue of this configuration, the cover disk and the housing can be produced in a simple manner during manufacture by injection molding. Particularly when the components are manufactured in large numbers, as is customary with motor vehicles, this leads to very low manufacturing costs. As a result, the manufacture of the webs and hence the production of the gap seal has a neutral effect on costs.

A contribution is made to a further reduction in the manufacturing costs of the centrifugal pump according to the invention if at least one of the components of the housing part or the cover disk is manufactured from plastic.

BRIEF DESCRIPTION OF THE DRAWINGS

The invention allows numerous embodiments. To further clarify the basic principles thereof, one of the embodiments is shown in the drawings and described below. In the drawings.

DETAILED DESCRIPTION OF THE PRESENTLY PREFERRED EMBODIMENTS

Figure 1:
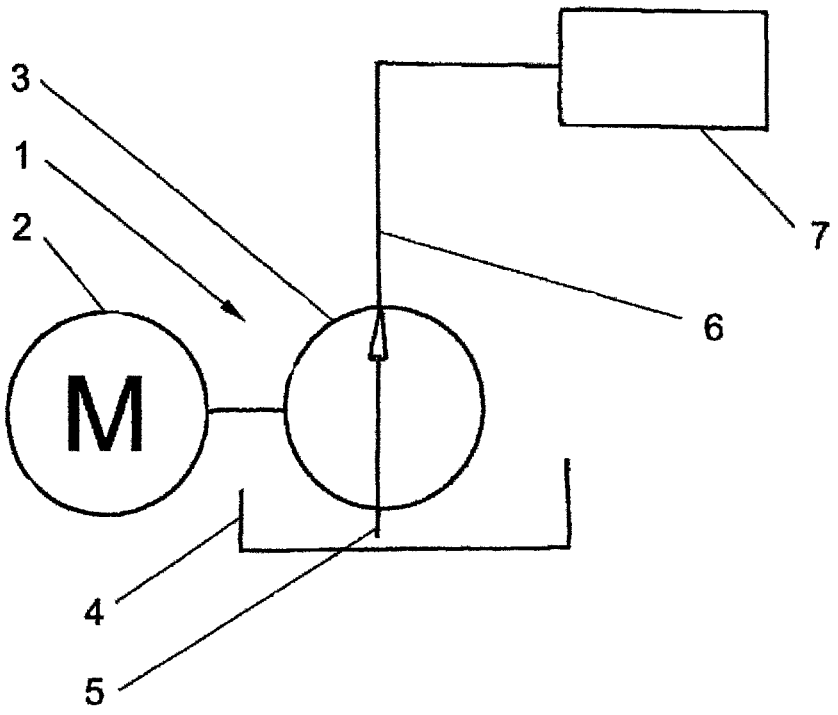
FIG. 1 shows a centrifugal pump according to the invention with adjoining components of a motor vehicle.

FIG. 1 shows a centrifugal pump 1 having a pump stage 3 driven by an electric motor 2. The centrifugal pump 1 draws in liquid from a reservoir 5 via an intake line 4 and delivers it to a consuming unit 7 via a delivery line 6.

Figure 2:
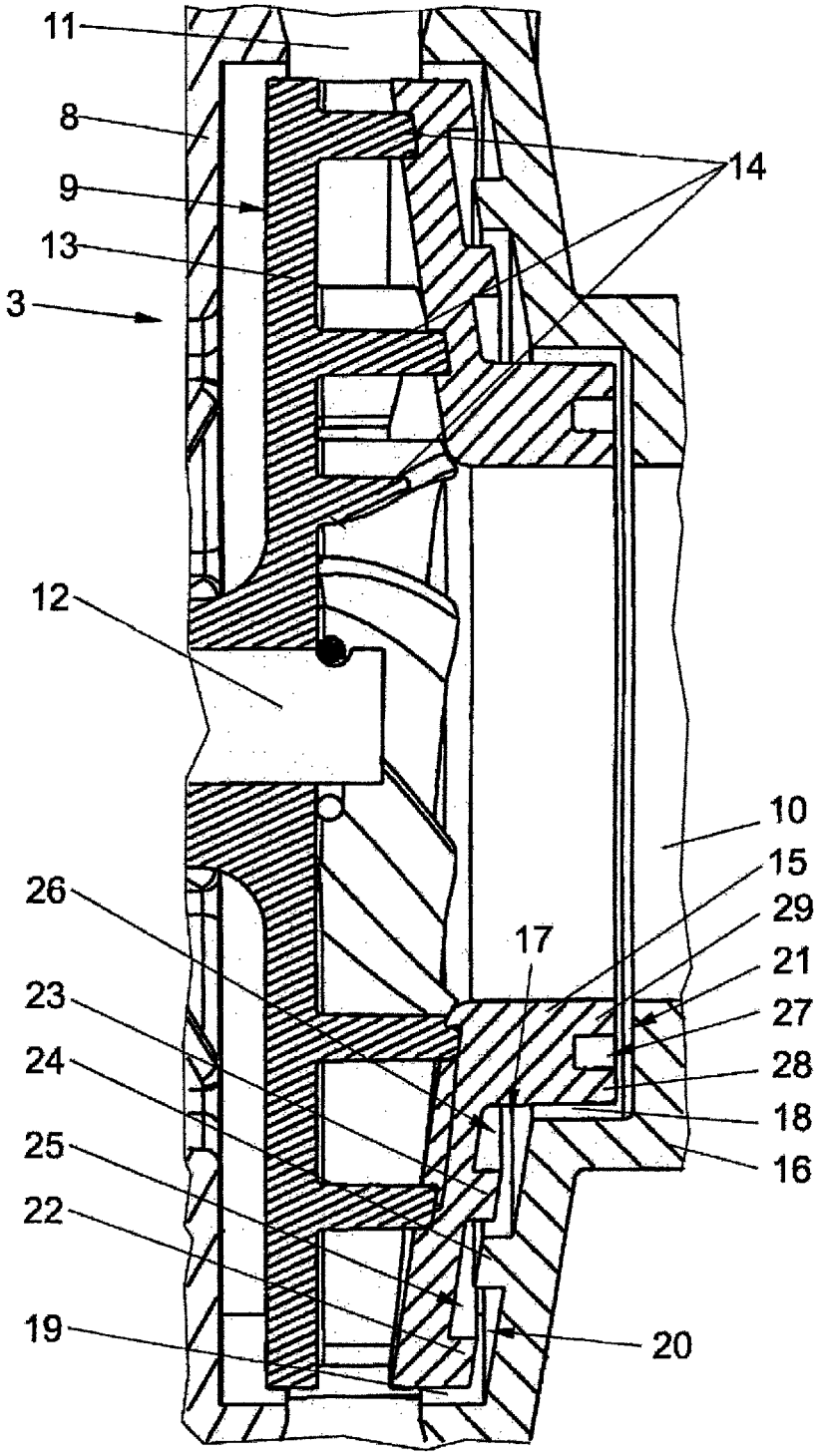
FIG. 2 shows a section through a pump stage of the centrifugal pump from FIG. 1.

FIG. 2 shows a section through the pump stage 3 of the centrifugal pump 1 from FIG. 1. The pump stage 3 has a housing 8 with a rotor 9 arranged rotatably therein, which is driven by the electric motor 2 from FIG. 1. The housing 8 has an intake duct 10, which is connected to the intake line 4, and an outlet duct 11, which is connected to the delivery line 6. The rotor 9 has a supporting disk 13 arranged for conjoint rotation on a shaft 12 of the electric motor 2 and having rotor blades 14 projecting therefrom. Free ends of radially outer rotor blades 14 are connected to a cover disk 15. A gap seal 17 is arranged between the cover disk 15 and a housing part 16 of the housing which lies opposite the cover disk 15.

The gap seal 17 has two annular ducts 18, 19 arranged concentrically with respect to the axis of rotation of the rotor and perpendicularly to the supporting disk 13. A first transverse duct 20 is arranged between the annular ducts 18, 19. The gap seal 17 furthermore has a second transverse duct 21, which is arranged at the intake duct 10. The first transverse duct 20 is arranged so as to slope relative to the plane of the supporting disk 13. The cover disk 15 and the housing part 16 lying opposite the cover disk 15 have webs 22-24, which each project into the gap seal 17 and are arranged offsets relative to one another. The webs 22-24 each cover half the height of the gap seal 17 and delimit chambers 25, 26 with different cross sections. Another chamber 27 adjoining the second transverse duct 21 is delimited by webs 28, 29 on the cover disk 15 and by a flat wall of the housing part 16.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A centrifugal pump (1) for delivering liquids in a motor vehicle, comprising:

a housing (8) delimiting an intake duct (10) and an outlet duct (11);

a driven rotor (9) configured to rotate in the housing (8) and having:

rotor blades (14) that project from a supporting disk (13) of the driven rotor (9), and a cover disk (15) that connects free ends of the rotor blades (14);

a housing part (16) of the housing (8) arranged opposite the cover disk (15);

a gap seal (17) arranged between the cover disc (15) and the housing part (16); and a plurality of projecting annular webs (22-24, 28, 29) arranged in the gap seal (17), at least one of the plurality of projecting annular webs (22, 23) being arranged on the cover disk (15) and at least one of the plurality of projecting annular webs (24) being arranged on the housing part (16), the at least one annular web (24) arranged on the housing part (16) being offset relative to the at least one annular web (22, 23) arranged on the cover disk (15), wherein the plurality of projecting annular webs (22-24) each cover half a height of the gap seal (17).

2. The centrifugal pump as claimed in claim 1, wherein annular webs (22-24) arranged opposite one another each project over half the height of the gap seal (17).

3. The centrifugal pump as claimed in claim 1, wherein the plurality of annular webs (22-24, 28, 29) delimit a plurality of chambers (25, 26) in the gap seal (17), the chambers having different cross sections.

4. The centrifugal pump as claimed in claim 1, wherein the annular webs (22-24, 28, 29) taper toward the free end thereof.

5. The centrifugal pump as claimed in claim 1, wherein at least one of the components of the housing part (16) or of the cover disk (15) is manufactured from plastic.

6. A centrifugal pump (1) for delivering liquids in a motor vehicle, comprising:

a housing (8) delimiting an intake duct (10) and an outlet duct (11);

a driven rotor (9) configured to rotate in the housing (8) and having:

rotor blades (14) that project from a supporting disk (13) of the driven rotor (9), and a cover disk (15) that connects free ends of the rotor blades (14);

a housing part (16) of the housing (8) arranged opposite the cover disk (15);

a gap seal (17) arranged between the cover disc (15) and the housing part (16); and a plurality of projecting annular webs (22-24, 28, 29) arranged in the gap seal (17), at least one of the plurality of projecting annular webs (22, 23) being arranged on the cover disk (15) and at least one of the plurality of projecting annular webs (24) being arranged on the housing part (16), the at least one annular web (24) arranged on the housing part (16) being offset relative to the at least one annular web (22, 23) arranged on the cover disk (15), wherein the gap seal (17) has a first annular duct (18) proximal to the intake duct (10) and a second annular duct (19) proximal to the outlet duct (11), said first and second annular ducts being arranged perpendicularly to the plane of the supporting disk (13) of the rotor (9), the first and second annular ducts (18, 19) being connected to one another by a first transverse duct (20) and the annular webs (22-24) project into the first transverse duct (20).

7. The centrifugal pump as claimed in claim 6, wherein the first transverse duct (20) connecting the first and second annular ducts (18, 19) to one another slopes relative to the plane of the supporting disk (13) of the rotor (9), and the annular webs (22-24) projecting into the first transverse duct (20) are arranged perpendicularly to the plane of the supporting disk (13) of the rotor (9).

8. The centrifugal pump as claimed in claim 7, wherein at least one of the first and second annular ducts (18) is connected to the intake duct (10) or the outlet duct (11) by a second transverse duct (21).

* * * * *